US006884090B2

(12) United States Patent
Kubota

(10) Patent No.: US 6,884,090 B2
(45) Date of Patent: Apr. 26, 2005

(54) ELECTRIC DISTRIBUTION BLOCK AND METHOD OF ASSEMBLING BUS BAR ON ELECTRIC DISTRIBUTION BLOCK

(75) Inventor: Katsuhiro Kubota, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/670,796

(22) Filed: Sep. 26, 2003

(65) Prior Publication Data

US 2004/0112624 A1 Jun. 17, 2004

(30) Foreign Application Priority Data

Sep. 26, 2002 (JP) ..... P2002-280732

(51) Int. Cl.[7] ..... H01R 12/00
(52) U.S. Cl. ..... 439/76.2; 439/709
(58) Field of Search ..... 439/709, 723, 439/76.2, 76.1, 212, 34, 153; 363/146, 144

(56) References Cited

U.S. PATENT DOCUMENTS 5,088,940 A * 2/1992 Saito ..... 439/621
5,795,193 A * 8/1998 Yang ..... 439/621

FOREIGN PATENT DOCUMENTS

| | | |
|---|---|---|
| EP | 0 438 120 A1 | 1/1991 |
| EP | 0 981 182 A1 | 2/2000 |
| GB | 2 343 559 A | 5/2000 |
| JP | 2000-83313 A | 3/2000 |

* cited by examiner

*Primary Examiner*—Alex Gilman
(74) *Attorney, Agent, or Firm*—Sughrue Mion, PLLC

(57) ABSTRACT

An electric distribution block includes a block body integrally formed with a connector mounting portion having a cavity therein, and a bus bar integrally formed with a terminal portion. A slit is formed in the connector mounting portion. The terminal portion is inserted into the connector mounting portion through the slit.

8 Claims, 5 Drawing Sheets

ELECTRIC DISTRIBUTION BLOCK AND METHOD OF ASSEMBLING BUS BAR ON ELECTRIC DISTRIBUTION BLOCK

BACKGROUND OF THE INVENTION

This invention relates to an electric distribution block which is mounted in an engine room of a vehicle or the like so as to supply a source current from a battery to various electrical equipments, and the invention also relates to a method of assembling bus bars on an electric distribution block.

An electric distribution block is a relay-purpose electric distribution part for supplying a source current from a battery to meters, switches, lamps and other electrical equipments, and this electric distribution block is mounted, for example, in an engine room of an automobile or around an instrument panel. The electric distribution block is a constituent assembling part of an electric distribution box, and in some cases, the electric distribution block cooperates with other electric distribution block to form a relay circuit or a fuse circuit or to form an ECU (Electronic Control Unit) for controlling various electrical equipments.

An electric distribution box has a box-like shape, and is called a relay box, a fuse box, a junction box or others. The electric distribution box includes an electric distribution block, a lower cover, an upper cover closing an opening in the lower cover. The electric distribution block is called a relay block, a fuse block, a junction block or others.

The electric distribution block is fixedly secured to the lower cover by retaining member, and is detachably fixed thereto so that it will not shake during the travel of the vehicle so as not to produce abnormal sounds, and will not be disengaged from the lower cover.

FIG. 5 shows one related electric distribution block of the type described which has been proposed by the Applicant of the present application (See, JP-A-2000-83313 (Pages 3 and 4, FIG. 1)). As shown in this Figure, the electric distribution block 100 includes a wiring board assembly 101 (serving as a block body) consisting of three stacked wiring boards 102, 102 and 102, a connector cavity member 104 releasably fixed to the wiring board assembly 101, bus bars 108 mounted on and over upper and lower surfaces of the wiring boards 102, and terminal portions 112 which are electrically connected at their one ends to the bus bars 108, and have the other end portions for insertion into the connector cavity member 104. The electric distribution block 100 is fixedly held between a (lower-side) lower cover 116 and an (upper-side) upper cover 117, and therefore is protected from external interference or others.

The wiring board 102 is molded of an insulative synthetic resin. A receiving hole 103 for receiving the lower end portions of the terminal portions 112 and terminal holding portions 106 of the connector cavity member 104 is formed through the upper wiring board 102.

The connector cavity member 104, serving as a connector mounting portion, includes a cavity body 105 for receiving a wire-side connector (not shown) connected to external circuits, and the terminal holding portion 106 formed on and projecting downwardly from an inner wall of the cavity body 105.

The bus bar 108 is formed by blanking a piece from an electrically-conductive metal sheet and then by bending this piece, and the bus bar has a flat portion 109 and a bent portion 110. The bent portion 110 is bent at right angles or at generally right angles, and is held in intimate contact with an inner peripheral surface of the receiving hole 103.

Like the bus bar 108, the terminal portion 112 is formed by blanking a piece from an electrically-conductive metal sheet and then by bending this piece. The terminal portion 112 includes a body portion 113, and a lower end portion of this body portion 113 is curved to form an integral resilient contact portion 114.

However, the above related electric distribution block 100 has the following problems to be solved.

Firstly, in the electric distribution block 100, the bus bars 108 and the terminal portions 112 are formed separately from each other, and also the wiring board assembly 101 and the connector cavity member 104 are formed separately from each other. Therefore, there is encountered a problem that the number of the component parts increases, so that the cost increases.

Secondly, the bus bars 108 and the terminal portions 112 which form internal circuits are mounted on the wiring board assembly 101, and the connector cavity member 104 is mounted in the receiving hole 103 in the wiring board assembly 101. By doing so, the electric distribution block 100 is assembled. Therefore, there is encountered a problem that the number of the component parts is large, so that much time is required for assembling the electric distribution block 100.

And besides, the connector cavity member 104 must be attached to the upwardly-projecting terminal portions 112 from the upper side, and there is a fear that the distal ends of the terminal portions 112 strike against the inner wall of the connector cavity member 104, and are bent.

SUMMARY OF THE INVENTION

It is therefore an object of the present invention to provide an electric distribution block and a method of assembling a bus bar on the electric distribution block, in which the cost of component parts is reduced by reducing the number of the component parts, and the efficiency of an operation for mounting a terminal portion on a connector cavity portion is enhanced.

In order to achieve the above object, according to the present invention, there is provided an electric distribution block, comprising:

a block body, integrally formed with a connector mounting portion which has a cavity therein; and a bus bar, integrally formed with a terminal portion, wherein a slit is formed in the connector mounting portion; and wherein the terminal portion is inserted into the connector mounting portion through the slit.

With this construction, a source current from a battery flows into the electric distribution block via a battery-side connector attached to the connector mounting portion, and is branched or relayed by the bus bar, and flows to electrical parts (such as relays and fuses) via the terminals formed on the bus bar, and flows out of the electric distribution block, and is supplied to electrical equipments via connectors.

The connector mounting portion is formed integrally with the block body, and the terminal portion is formed integrally with the bus bar. Therefore, the number of the component parts is reduced, so that the cost of the component parts is reduced. And besides, the slit for inserting the terminal portion is formed in the connector mounting portion, and therefore the efficiency of the operation for mounting the terminal portion on the block body is enhanced.

Preferably, the connector mounting portion has a first wall and a second wall which is connected to the first wall through an edge of the first wall. The slit includes a first slit formed in the first wall and a second slit formed in the second wall. The first slit and the second slit are connected each other at the edge.

With this construction, the terminal portion, formed integrally with the bus bar, is inserted through the second slit, and slides along the first slit, and is held on the block body. Therefore, the efficiency of the operation for mounting the terminal portion on the block body is enhanced, and besides the terminal portion is positively held in the first slit.

Here, it is preferable that, the connector mounting portion has an open portion exposing the cavity. A closed end of the second slit is disposed in spaced relation to an open end of the open portion.

With this construction, the slit is not formed in the open end of the connector mounting portion, and when the connector is inserted into the connector mounting portion, the open end is prevented from being much deformed and spread. Therefore, the connector is prevented from being withdrawn from the connector mounting portion, and is prevented from shaking in the connector mounting portion, so that the reliability of the electrical connection is enhanced.

Preferably, the bus bar has a plurality of terminals extending in a direction perpendicular to an extending direction of the terminal portion. The block body includes a bus bar mounting portion for connecting the plurality of terminals.

With this construction, the terminal portion and the plurality of terminals are simultaneously attached to (or inserted in) the block body. Therefore, the time and labor, required for attaching the terminal portion and the terminals to the block body, are reduced, so that the efficiency of the assembling operation is enhanced.

Preferably, the first slit extends in a first direction. The second slit extends in a second direction perpendicular to the first direction.

Here, it is preferable that, the connector mounting portion has a first wall and a second wall which is connected to the first wall through an edge of the first wall. The slit includes a first slit formed in the first wall and a second slit which formed in the second wall. The first slit and the second slit are connected each other at the edge. The bus bar mounting portion is provided on a forming face of the block body. The forming face is parallel with the second wall, and is perpendicular to the first face.

According to the present invention, there is also provided a method of assembling a bus bar on an electric distribution block comprising, the steps of:

providing a bus bar integrally formed with a terminal portion, the bus bar having a plurality of terminals extending in a direction perpendicular to an extending direction of the terminal portion;

providing a block body having a bus bar mounting portion and integrally formed with a connector mounting portion, the connector mounting portion having a first wall and a second wall which is connected to the first wall through an edge of the first wall, a first slit being formed in the first wall, a second slit being formed in the second wall, and the first slit and the second slit being connected each other at the edge;

inserting the terminal portion of the bus bar into the connector mounting portion through the second slit; and inserting the plurality of terminals into the bus bar mounting portion.

With this method, the terminal portion of the bus bar and the terminals of the bus bar are simultaneously attached to the block body. Therefore, the time and labor, required for attaching the terminal portion and the terminals to the block body, are reduced, so that the efficiency of the assembling operation is enhanced.

Preferably, the bus bar mounting portion is provided on a forming face of the block body, the forming face being parallel with the second wall, and being perpendicular to the first face. The terminal portion and the plurality of terminals of the bus bar is inserted along an extending direction of the first slit.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of the present invention will now be described in detail with reference to the drawings.

FIGS. 1 to 4 show one preferred embodiment of an electric distribution block of the invention and a method of mounting bus bars on this electric distribution block.

Figure 1:
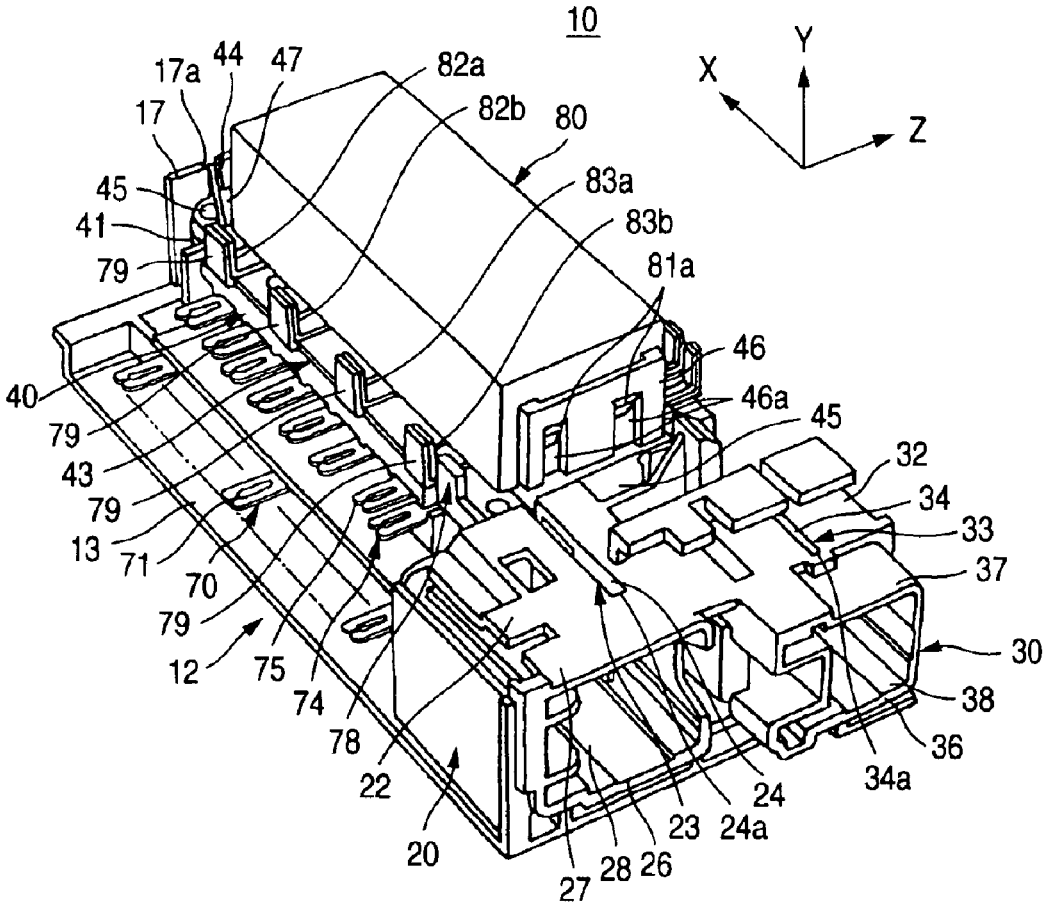
FIG. 1 is a perspective view showing one preferred embodiment of a power block (electric distribution block) of the invention.

The power block (electric distribution block) 10, shown in FIG. 1, is received within an electric distribution box (not shown), and this power block is an assembling part which cooperates with a plurality of connector blocks (not shown), wiring boards (not shown) forming branch circuits, an ECU (not shown) forming a control circuit, and so on to form relay-purpose internal circuits, and supplies a source current from a battery (not shown) to external circuits (not shown) formed by electrical equipments such as lamps and meters.

This power block 10 differs from the related electric distribution block 100 mainly in that connector cavity portions (connector mounting portions) 20 and 30 are formed (molded) integrally with a fuse plate (block body) 12, that power terminals (terminal portions) 55 and 65 (FIG. 3) are formed integrally with power bus bars 50 and 60 (FIG. 3), respectively, and that L-shaped (or crossed) slits 23 and 33 for inserting the power terminals 55 and 65 respectively into the connector cavity portions 20 and 30 are formed in the connector cavity portions 20 and 30, respectively. A feature of the invention resides in the fact that the power terminals 55 and 65 are inserted respectively through the slits 23 and 33 in a vertical direction.

Figure 2:
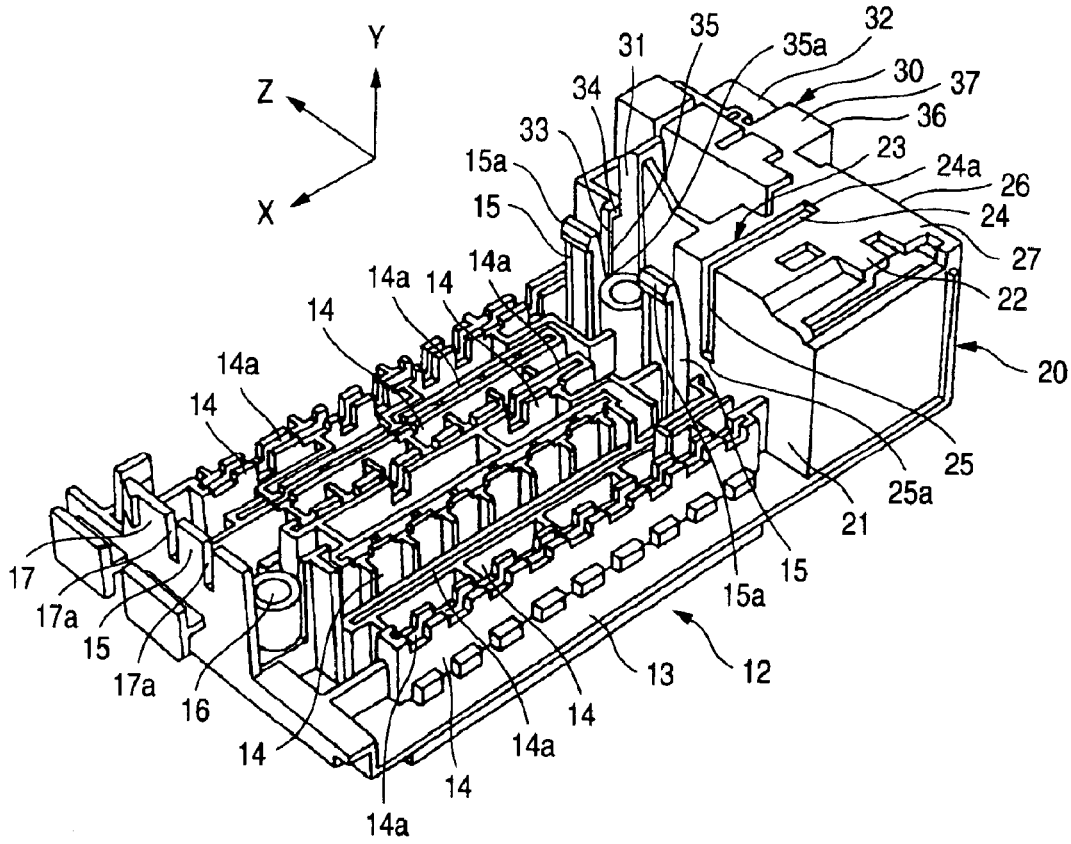
FIG. 2 is a perspective view of a fuse plate shown in FIG. 1.

As shown in FIG. 2, the slits 23, 33 have horizontal slits 24, 34 and vertical slits 25, 35 respectively. The horizontal slits 24, 34 are narrow grooves formed through a side wall 22, 32 of the connector cavity portion 20, 30, and extends in a forward-rearward direction X. The vertical slits 25, 35 are narrow grooves formed through inner end walls 21, 31 of the connector cavity portions 20, 30, and extend in an upward-downward direction Y.

Figure 3:
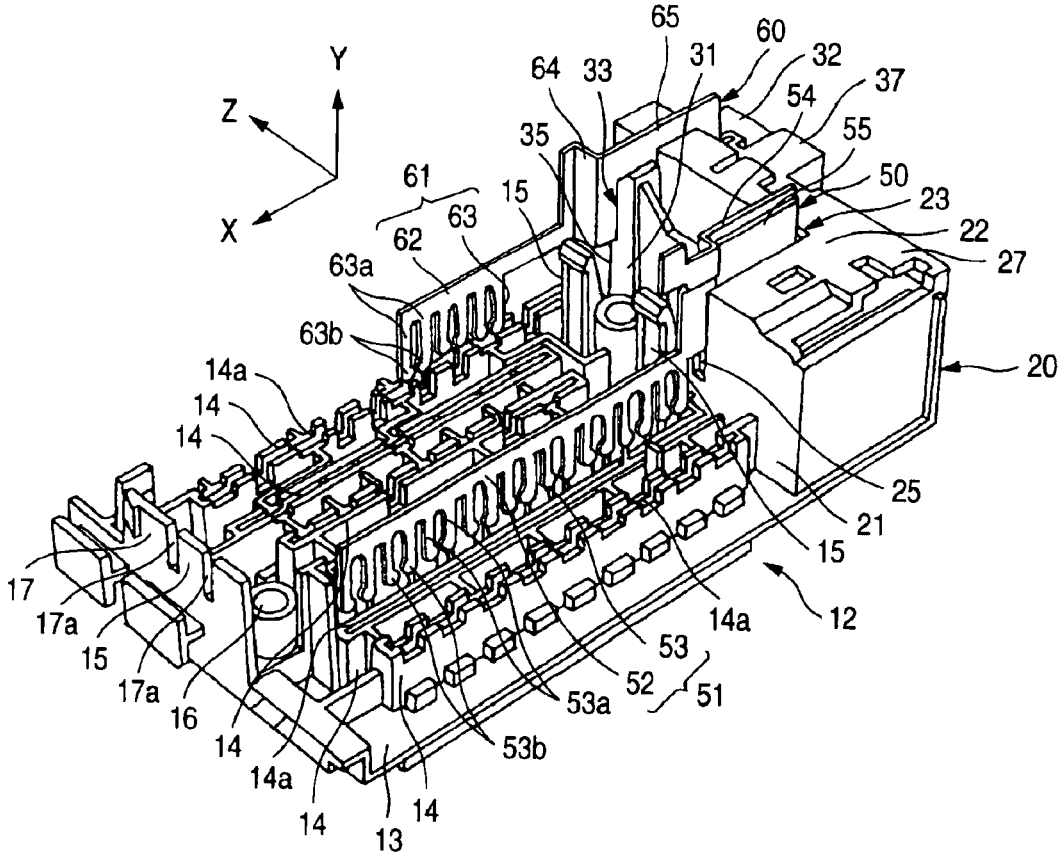
FIG. 3 is a perspective view showing a condition in which power bus bars are in the process of being attached to the fuse plate.
Figure 4:
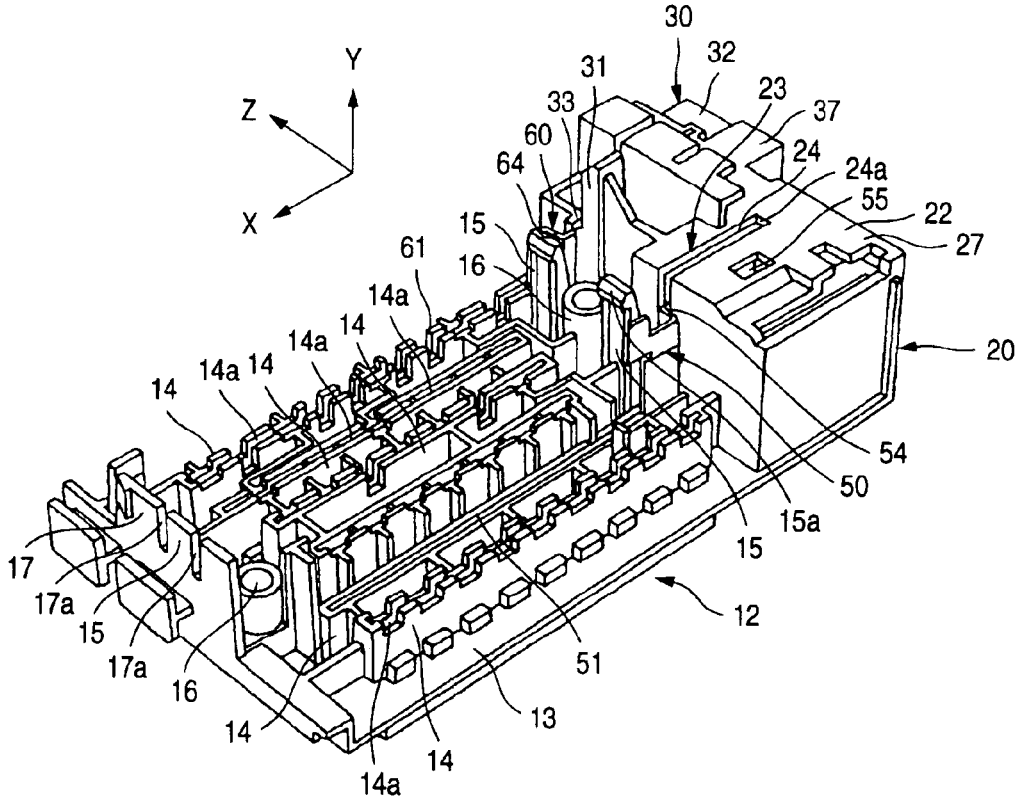
FIG. 4 is a perspective view showing a condition in which the power bus bars are attached to the fuse plate.
Figure 5:
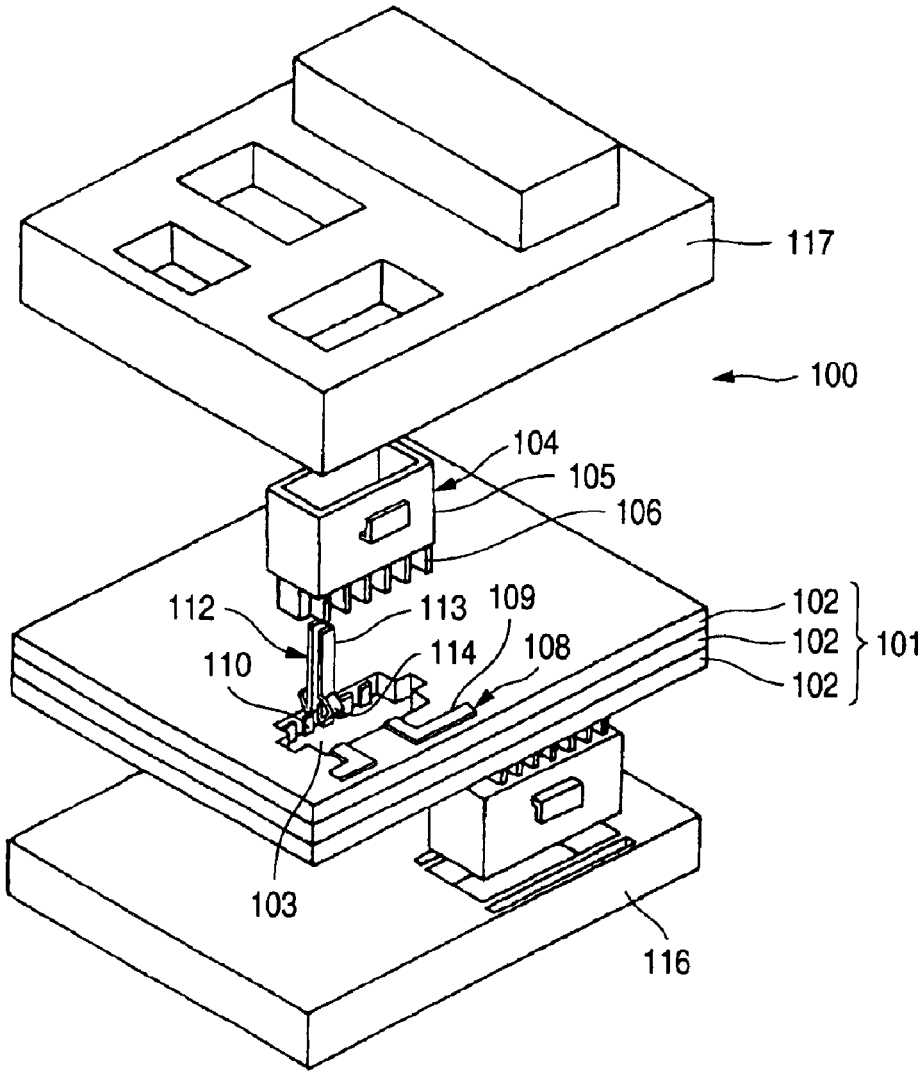
FIG. 5 is an exploded, perspective view showing one related electric distribution block.

As shown in FIG. 3, the power terminals 55, 65 are formed into a plate-like shape, and are inserted into the connector cavity portions 20, 30 through the horizontal slits 24, 34 (FIG. 2) in a vertical direction relative to the fuse plate 12, and is further inserted downward while guided by the vertical slits 25, 35. When lower ends of the power terminals 55, 65 abut against closed ends 25*a*, 35*a* (FIG. 2) of the vertical slits 25, 35, the power terminals 55, 65 are positioned in the upward-downward direction Y and a right-left direction Z, and are kept projected into the interior of the connector cavity portions 20, 30 (FIG. 4). The widths of the horizontal slits 24, 34 (FIG. 2) and the widths of the vertical slits 25, 35 are generally equal to the wall thicknesses of the power terminals 55, 65, and the power terminals 55, 65 are gripped by the vertical slits 25, 35 to be positively held in position.

The power terminals 55, 65 are disposed in a vertical direction, and by doing so, the width of the fuse, plate 12 can be reduced, and therefore a compact design can be achieved. In contrast, the density of installation of bus bars 50, 60, 70, 74 and 78 (FIG. 1) can be increased without changing the size of the fuse plate 12. And besides, the power terminals 55, 65 are inserted through the horizontal slits 24, 34, and by doing so, the power terminals 55, 65 can be easily mounted on the connector cavity portions 20, 30, and the distal ends of the power terminals 55, 65 are prevented from damage.

A feature of the invention resides in that a closed ends 24*a*, 34*a* (FIG. 1) of the horizontal slits 24, 34, extending toward an open ends of the connector cavity portions 20, 30, are disposed in spaced relation to the open ends 26, 36. If the closed ends 24*a*, 34*a* of the horizontal slits 24, 34 are formed to extend to the open ends 26, 36, the connector cavity portions 20, 30 are divided by the horizontal slits 24, 34 respectively, and the connector cavity portions 20, 30 are distorted, and when a connector (not shown) is inserted into the connector cavity portions 20, 30, the open ends 26, 36 are much spread, so that the positioning of the connector can not be accurately effected. As a result, there are possibilities that a female terminal, received in a terminal receiving chamber in the connector, and the power terminals 55, 65 are disposed out of registry with each other and that the connector is withdrawn from the connector cavity portions 20, 30, thus adversely affecting the reliability of the electrical connection.

The lengths of the horizontal slits 24, 34 are generally equal to or larger than the lengths of the power terminals 55, 65 (FIG. 3). A hood portions 27, 37 of the connector cavity portions 20, 30 are formed to be extended forwardly, and by doing so, the closed ends 24*a*, 34*a* of the horizontal slits 24, 34 are disposed in spaced relation to the open ends 26, 36 of the connector cavity portions 20, 30, and therefore the open ends (or edges) 26, 36 of the connector cavity portions 20, 30 are not interrupted, thereby maintaining the reliability of the electrical connection.

The closed ends 25*a*, 35*a* of the vertical slits 25, 35 are disposed generally centrally of the height of the inner end walls 21, 31. The power terminals 55, 65 are inserted through the horizontal slits 24, 34 in a vertical direction, and are slid downward in an amount corresponding to the lengths of the vertical slits 25, 35, and are held in a projected condition in the position corresponding to the position of the female terminal in the connector.

In this specification, for description purposes, the forward-rearward direction X, the upward-downward direction Y and the right-left direction Z will be defined as follows. The forward-rearward direction X is the direction of the length of the fuse plate 12, and that side where the connector cavity portions 20 and 30 are disposed is the front side, and the opposite side of the front side is the rear side. The upward-downward direction Y is the direction of the thickness of the fuse plate 12, and that side from which the connector cavity portions 20 and 30 project is the upper side, and the opposite side of the upper side is the lower side. The right-left direction Z is the direction perpendicular to the forward-rearward direction X and the upward-downward direction Y, and more specifically this direction Z is the direction of the width of the horizontal slits 24 and 34 and the direction of the width of the vertical slits 25 and 35.

Next, the constituent parts of the power block 10 will be described. As shown in FIG. 1, the power block 10 includes the fuse plate 12 having the connector cavity portions 20 and 30, the plurality of bus bars 50, 60, 70, 74 and 78 provided in a stacked manner on an upper surface 13 of the fuse plate 12, a plate-like insulating plate 40 insulating the bus bars 70 and 74 from each other, a relay plate 43 on which a relay unit 80 is mounted, the relay unit 80 forming a relay circuit, and fuses (not shown) forming a fuse circuit.

The power block 10, together with the connector blocks, the wiring boards, the body-side ECU and so on, is detachably fixed to a lower cover, and an upper cover is fitted on the lower cover, thereby forming the electric distribution box A feature of the invention is resides in that the power block 10 is secured to a side surface of the lower cover. A structure of fixing the power block 10 to the lower cover will be described in detail in other patent application, and explanation thereof will be omitted in this specification.

As shown in FIG. 2, the fuse plate 12 has a rectangular block-shape, and is molded into an integral construction by injection molding a synthetic resin. The connector cavity portions 20 and 30, a plurality of bus bar-mounting portions 14 and retaining member 15 for the lower cover are formed on the upper surface 13 of the fuse plate 12. Fuse-mounting portions are formed on a lower surface (not shown) of the fuse plate 12.

The two connector cavity portions 20 and 30 are formed on a front end portion of the fuse plate 12. The number of the connector cavity portions (20 and 30) is not limited to two, and may be one or more than two.

If a plurality of connector cavity portions (20, 30) are formed on the upper and lower surfaces 13 (only the upper surface is shown) of the fuse plate 12, the size of the power block 10 in the upward-downward direction Y increases, so that a thin and compact design of the power block. 10 can not be achieved.

The first and second connector cavity portions 20 and 30 have a box-like shape, and are different in size from each other (FIG. 1). The connector cavity portions 20 and 30 correspond in size to the battery-side connector, and the two connector cavity portions 20 and 30 may have the same size.

The connector cavity portions 20, 30 include the inner end walls 21, 31, and the side walls 22, 32 extending perpendicularly from edges of the inner end walls 21, 31 respectively. The side walls 22, 32 form an outer frame of the connector cavity portions 20, 30. As described above, the right-angled slits 23, 33 are formed through the inner end walls 21, 31 and the side walls 22, 32 respectively. The front sides of the connector cavity portions 20, 30, opposed to the inner end walls 21, 31, are open (FIG. 1), thereby forming connector fitting portions 28, 29 for the battery-side connector.

The open ends (openings) of the connector cavity portions 20, 30 are directed to the front side in the longitudinal direction of the fuse plate 12. With this construction, receiving spaces for receiving wires extending from the connector are formed in the longitudinal direction of the fuse plate 12, and therefore the size of the fuse plate 12 will not increase in the direction of the thickness thereof, and the fuse plate 12 can be formed into a thin design. And besides, the connector-attaching ability can be enhanced.

The bus bar-mounting portions 14 serve as the mounting portions for the power bus bars 50 and 60 and the branch-purpose bus bars 70, 74 and 78 (FIG. 1). These bus bar-mounting portions 14 are formed upright on th upper surface 13 of the fuse plate 12. The interior of the bus bar-mounting portion 14 is formed into a slot-like groove 14*a*, and the groove 14*a* is divided into a plurality of sections by partition walls, and tuning fork-type terminals 53 and 63 (FIG. 3) (for the fuses), formed on the power bus bars 50 and 60 and the branch-purpose bus bars 70 and 74, are inserted into these section chambers.

The retaining member 15 includes two retaining portions formed upright on the font end portion of the fuse plate 12, and one retaining portion formed upright on the rear end of the fuse plate 12. By thus providing the three retaining portions 15 at the front and rear portions the power block 10 can be fixed to the lower cover without shaking. A claw 15*a* is formed at a distal end of each retaining portion 15, and engagement portions, corresponding respectively to the claws 15*a*, are formed on the lower cover. The power block 10 is attached to the lower cover by engaging the claws 15*a* respectively with the engagement portions.

An upstanding wall 17 is formed at the rear end of the fuse plate 12, and a pair of guide grooves 17*a* are formed in the upstanding wall 17. An upper end of each guide groove 17*a* is open, and guide ribs 44, formed on a rear wall 47 of the relay plate 43 (FIG. 1), are inserted respectively into the guide grooves 17*a* through these open ends, thereby positioning the relay plate 43 in the right-left direction Z.

As shown in FIG. 3, each of the pair of power bus bars 50 and 60 has a plate-like shape, and is formed by blanking a piece from an electrically-conductive sheet and by bending this piece if necessary. The power bus bars 50, 60 include a body portions 51, 61 having the plurality of tuning fork-type terminals 53, 63 formed integrally therewith, and the power terminals 55, 66 connected to the body portions 51, 61 through interconnecting portions 54, 64.

The body portions 51, 61 include link portions 52, 62, and the tuning fork-type terminals 53, 63 extending perpendicularly from the link portions 52, 62. The link potions 52, 62 extend in the forward-rearward direction X, and the tuning fork-type terminals 53, 63 extend in the upward-downward direction. The link portions 52, 62 are disposed in parallel relation to the power terminals 55, 66, and extend in the longitudinal direction of the fuse plate 12. The tuning fork-type terminals 53, 63 are disposed perpendicularly to the power terminals 55, 65.

The interconnecting portions 54, 64, integrally interconnecting the body portions 51, 61 and the power terminals 55, 65, are bent at an angle of 90 degrees relative to the power terminals 55, 65. Therefore, when the power bus bars 50, 60 are mounted on the fuse plate 12, the power terminals 55, 65 are inserted into the connector cavity portions 20, 30 through the slits 23, 33, and at the same time the interconnecting portions 54, 64 abuts against the inner end walls 21, 31 of the connector cavity portions 20, 30, thereby positioning the power bus bars 50, 60 in the forward-rearward direction X.

The first power bus bar 50 is longer than the second power bus bar 60 in the forward-rearward direction X, and nine (9) tuning fork-type terminals 53 are formed integrally on the body portion 51 of the first power bus bar 50, and three (3) tuning fork-type terminals 63 are formed integrally on the body portion 61 of the second power bus bar 60.

Each of the tuning fork-type terminals 53 and 63 is a female terminal of a bifurcated shape, and includes a pair of gripping piece portions 53*a* and 53*a* (63*a* and 63*a*) extending perpendicularly from the straight link portions 52, 62. Inwardly-directed projections 53*b*, 63*b* are formed respectively on distal end portions of the pair of gripping piece portions 53*a* and 53*a* (63*a* and 63*a*), and are adapted to be electrically contacted with a male terminal inserted between the pair of gripping piece portions 53*a* and 53*a* (63*a* and 63*a*). The pair of gripping piece portions 53*a* and 53*a* (63*a* and 63*a*) can be resiliently deformed, and can grip the male terminal with its resilient restoring force, thereby securing the positive electrical contact. The male terminals for connection to the tuning fork-type terminals 53 and 63 are fuse terminals of the fuses (not shown).

The tuning fork-type terminals 53, 63 are thus formed on the body portions 51, 61, and by doing so, the pitch of the adjacent tuning fork-type terminals 53, 63 can be reduced, and the power block 10 can be formed into a compact size in the longitudinal direction. It is effective to apply an electrically-conductive coating onto the projections 53*b* and 53*b* of each pair of gripping piece portions 53*a* and 53*a* (63*a* and 63*a*). By thus providing the coating, wear of the projections 53*b* and 63*b* is reduced, so that the positive electrical contact of each tuning fork-type terminal with the corresponding male terminal is maintained.

When the power terminals 55, 65 of the power bus bars 50, 60 are inserted in a vertical direction into the connector cavity portions 20, 30 through the horizontal slits 24, 34 formed through the side walls 22, 32 of the connector cavity portions 20, 30, the tuning fork-type terminals 53, 63 are inserted in a vertical direction into the bus bar-mounting portion 14.

Namely, when the power bus bars 50, 60 ar moved in one direction (the upward-downward direction Y), and are mounted on th fuse plate 12, the power terminals 55, 65 are inserted into the connector cavity portions 20, 30 while the tuning fork-type terminals 53, 63 are inserted into the bus bar-mounting portion 14. Therefore, labor, required for attaching the power terminals 55 and 65 and the tuning fork-type terminals 53 and 63 is reduced, so that the efficiency of the assembling operation is enhanced.

Referring again to FIG. 1, each of the branch-purpose bus bars 70, 74 and 78 has a flat portion (not shown), and a bent portion (not shown) extending upright from the flat portion. A press-contacting terminals 71, 75 for connection to a wire connected to the electrical equipment (such as a meter and a lamp) is formed at a distal end of the flat portion of each of the branch-purpose bus bars 70, 74 in the three-layer construction, while a tuning fork-type terminal for connection to the fuse terminal is formed at the bent portion. This tuning fork-type terminal is similar to the tuning fork-type terminals 53, 63 of the power bus bars 50, 60, and is the tuning fork-type female terminal of a bifurcated shape.

The branch-purpose bus bars 70, 74 and 78 are installed on the fuse plate 12 in such a manner that these bus bars are stacked in three layers. The branch-purpose bus bars 70, 74 and 78, arranged in three layers, are insulated from one another by the insulating plate 40 and the relay plate 43 so that, the short-circuiting of the three layers of bus bars will not occur.

Plate terminals 79 for connection respectively to terminals 82*a*, 82*b*, 83*a* and 83*b* (only four of them which are disposed on one side of the relay unit 80 are shown) of the relay unit 80 are formed by bending at the branch-purpose bus bars 78 disposed in the uppermost layer. The terminals 82*a*, 82*b*, 83*a* and 83*b* of the relay unit 80 are connected respectively to the plate terminals 79 of the branch-purpose bus bars 78 by thermal welding or the like.

The insulating plate 40 is molded into an integral construction, using a synthetic resin. This insulating plate 40 is an insulating part for preventing the short-circuiting between the lowermost-layer branch-purpose bus bars 70 and the intermediate-layer branch-purpose bus bars 74. Mounting portions 41 (only one of them which is provided at the rear end portion of the insulating plate 40 is shown), having a bolt insertion hole, are formed at the front and rear end portions of the insulating plate 40, respectively. The mounting portions 41 are laid on mounting portions 16 (FIG. 2) of the fuse plate 12, respectively, and by tightening fastening bolts (not shown) passing respectively through the bolt insertion holes, the insulating plate 40 is fixed to the fuse plate 12.

Grooves (not shown) for receiving the branch-purpose bus bars 70 are formed in the lower surface of the insulating plate 40 are formed, while grooves (not shown) for receiving the branch-purpose bus bars 74 are formed in the upper surface of the insulating plate 40. The branch-purpose bus bars 70 and 74 are received in these grooves, so that these bus bars 70 and 74 are prevented from short-circuiting, and also are prevented from being displaced out of position.

Like the insulating plate 40, the relay plate 43 is molded into an integral construction, using a synthetic resin. This relay plate 43 is disposed above the insulating plate 40, and insulates the intermediate-layer branch-purpose bus bars 74 from the uppermost-layer branch-purpose bus bars 78, and the box-like relay unit 80 is mounted on this relay plate 43.

A front wall 46 and a rear wall 47 are formed upright at front and rear ends of the relay plate 43, respectively. Each of the front and rear walls 46 and 47 has two rectangular retaining holes 46*a* (only those of which are formed in the front wall are shown). Retaining projections 81*a* are formed on each of a front surface 81 and a rear surface of the relay unit 80 (Only those retaining projections 81*a*, formed on the front surface, are shown), and these retaining projections 81*a* are engaged in the retaining holes 46*a*, respectively, thereby fixing the relay unit 80 to the relay plate 43.

Like the insulating plate 40, the relay plate 43 has mounting portions 45 (each having a bolt insertion hole) integrally formed respectively at the front and rear end portions thereof. The mounting portions 45 are laid on the mounting portions 41 of the insulating plate 40, respectively, and by tightening the fastening bolts, the relay plate 43, together with the insulating plate 40, is fixed to the fuse plate 12.

The relay unit 80 includes two relays (not shown), and the terminals 82*a*, 82*b*, 83*a* and 83*b* (only the input/output terminals of four contact members are shown) project downwardly from the relay unit. Each of the relays includes a body, and the four input/output terminals. The body includes an electromagnetic coil, and the contact members. The four input/output terminals are input/output terminals of the electromagnetic coil and the input/output terminals 82*a* and 82*b* (83*a* and 83*b*) of the contact members. These input/output terminals are connected respectively to the plate terminals 79 (formed upright at the uppermost-layer branch-purpose bus bars 78) by thermal welding, resistance welding or the like, thereby forming the relay circuit.

Each of the fuses (not shown) includes a body, and two terminals, and two fuses are provided for each relay. As described above, the relay includes the input terminal of the electromagnetic coil and the input terminals of the contact members, and the source current of a predetermined value is supplied from the battery to each input terminal through the fuse.

As described above, in this embodiment, the Connector cavity portions 20 and 30 are formed integrally with the fuse plate 12, and the power terminals 55 and 65 are formed integrally with the power bus bars 50 and 60, respectively. Therefore, the number of the component parts is reduced, so that the cost of the component parts is reduced. And besides, the right-angled slit 23 is formed through the inner end wall 21 and the side wall 22, while the right-angled slit 33 is formed through the inner end wall 31 and the side wall 32, and therefore the power terminals 55 and 65 can be easily mounted on the connector cavity portions 20 and 30, respectively.

Technical ideas which can be grasped from the above embodiment, will be described in the following.

(1) It is also effective to provide the first and second connector cavity portions 20 and 30 on one side portion of the fuse plate 12. With this construction, the first and second connector cavity portions 20 and 30 are not formed on the upper and lower sides of the fuse plate 12, and therefore the size of the fuse plate 12 is prevented from increasing in the upward-downward direction, so that the power block 10 can be formed into a compact design.

(2) One feature of the invention resides in that the direction of fitting of the connector into the first and second connector cavity portions 20 and 30 is the longitudinal direction (forward-rearward direction X) of the fuse plate 12. With this construction, the receiving spaces for receiving the wires extending from the connector are formed in the longitudinal direction of the fuse plate 12, and therefore the size of the fuse plate 12 is prevented from increasing in the direction of the thickness thereof, so that the fuse plate 12 can be formed into a thin design. And besides, the ability of attaching the connector to the first and second connector cavity portions 20 and 30 is enhanced.

(3) Another feature of the invention resides in that each of the power terminals 55 and 65 is inserted in a vertical direction into the first (second) connector cavity 20 (30) through the horizontal slit 24 (34). With this construction, the width of the fuse plate 12 can be reduced, so that the fuse plate can be formed into a compact design.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electric distribution block, comprising:

a block body, integrally formed with a connector mounting portion which has a cavity therein, the connector mounting portion including a female housing defining said cavity; and a bus bar, integrally formed with a terminal portion, wherein a slit is formed in the connector mounting portion;

wherein the terminal portion is inserted into the connector mounting portion by passing the terminal portion through the slit so as to be received in said cavity, wherein the female housing has a face opposed to an insertion direction of the terminal portion into the cavity and wherein the slit is formed on the face of the female housing.

2. The electric distribution block as set forth in claim 1, wherein the bus bar has a plurality of terminals extending in a direction perpendicular to an extending direction of the terminal portion; and wherein the block body includes a bus bar mounting portion for connecting the plurality of terminals.

3. The electric distribution block as set forth in claim 2, wherein the connector mounting portion has a first wall and a second wall which is connected to the first wall through an edge of the first wall;

wherein the slit includes a first slit formed in the first wall and a second slit which formed in the second wall;

wherein the first slit and the second slit are connected each other at the edge;

wherein the bus bar mounting portion is provided on a forming face of the block body; and wherein the forming face is parallel with the second wall, and is perpendicular to the first face.

4. The electric distribution block as set forth in claim 1, wherein the connector mounting portion has a first wall and a second wall which is connected to the first wall through an edge of the first wall;

wherein the slit includes a first slit formed in the first wall and a second slit formed in the second wall; and wherein the first slit and the second slit are connected each other at the edge.

5. The electric distribution block as set forth in claim 4, wherein the connector mounting portion has an open portion exposing the cavity; and wherein a closed end of the second slit is disposed in spaced relation to an open end of the open portion.

6. The electric distribution block as set forth in claim 4, wherein the first slit extends in a first direction; and wherein the second slit extends in a second direction perpendicular to the first direction.

7. A method of assembling a bus bar on an electric distribution block comprising, the steps of:

providing a bus bar integrally formed with a terminal portion, the bus bar having a plurality of terminals extending in a direction perpendicular to an extending direction of the terminal portion;

providing a block body having a bus bar mounting portion and integrally formed with a connector mounting portion having a cavity therein, the connector mounting portion having a first wall and a second wall which is connected to the first wall through an edge of the first wall, a first slit being formed in the first wall, a second slit being formed in the second wall, and the first slit and the second slit being connected each other at the edge;

inserting the terminal portion of the bus bar into the cavity of the connector mounting portion by passing the terminal portion through the second slit; and inserting the plurality of terminals into the bus bar mounting portion.

8. The method as set forth in claim 7, wherein the bus bar mounting portion is provided on a forming face of the block body, the forming face being parallel with the second wall, and being perpendicular to the first face; and wherein the terminal portion and the plurality of terminals of the bus bar is inserted along an extending direction of the first slit.

* * * * *